US006905330B2

(12) United States Patent
Ohlin

(10) Patent No.: US 6,905,330 B2
(45) Date of Patent: Jun. 14, 2005

(54) JUGGLING TORCH

(76) Inventor: Ivan Ohlin, Berhagsvägen 3, 178 52, Ekerö (SE)

( * ) Notice: Subject to any disclaimer, the term of this patent is extended or adjusted under 35 U.S.C. 154(b) by 0 days.

(21) Appl. No.: 10/717,691

(22) Filed: Nov. 20, 2003

(65) Prior Publication Data

US 2004/0198504 A1 Oct. 7, 2004

(30) Foreign Application Priority Data

Dec. 10, 2002 (SE) ..... 0203652

(51) Int. Cl.[7] ..... F23D 3/24
(52) U.S. Cl. ..... 431/320; 472/137
(58) Field of Search ..... 472/60, 137; 431/255, 431/291, 295, 320, 343, 344; 434/202

(56) References Cited

U.S. PATENT DOCUMENTS 3,516,774 A * 6/1970 Livingstone ..... 431/323
5,163,879 A * 11/1992 Black ..... 472/66
5,218,152 A * 6/1993 Campbell et al. ..... 84/422.4
5,547,371 A * 8/1996 Rose ..... 431/320
5,902,101 A * 5/1999 Palmer et al. ..... 431/202

FOREIGN PATENT DOCUMENTS

FR 2799658 A1 * 4/2001 ..... A63B/67/00
GB 2272165 A * 5/1994 ..... A63J/7/00

* cited by examiner

*Primary Examiner*—K. T. Nguyen
(74) *Attorney, Agent, or Firm*—Rolf Fasth; Fasth Law Offices

(57) ABSTRACT

The juggling torch has a torch body (1) with a wick (3) for fuel that is absorbed by the wick (3) and a fuel container (7) that is connected to the wick (3) via one or many channels (15).

7 Claims, 1 Drawing Sheet

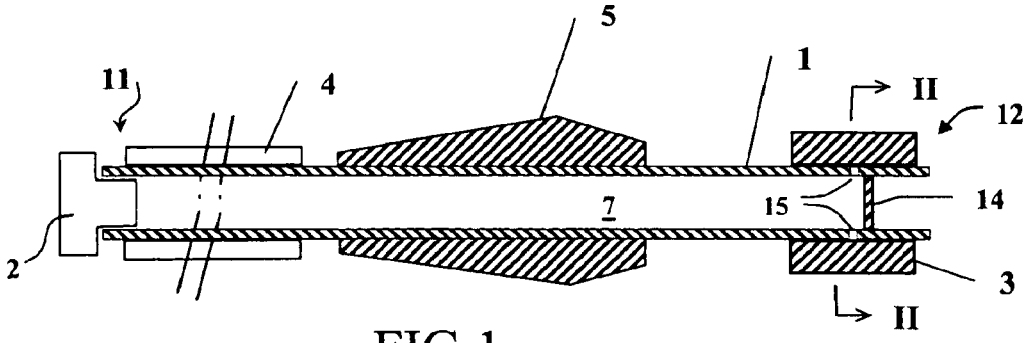
FIG 1
FIG 2
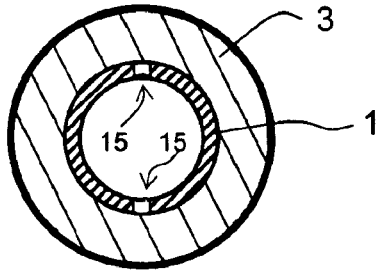

JUGGLING TORCH

PRIOR APPLICATION

This application is a U.S. national phase application based on Swedish Patent Application No. 0203652-3, filed Dec. 10, 2002.

The invention relates to a juggling torch.

BACKGROUND AND SUMMARY OF INVENTION

In the field of entertainment artists sometimes work with a juggling torch such as a juggling club or the like that has a wick in which fuel is absorbed so that fuel is lit and permitted to burn while the torch is handled wherein the artist's act is performed in a room that is dark or has moderate lighting. The term juggling torch is intended to include all types of torches or devices that have a wick into which a burning fuel is absorbed and that is handled by the artist. Examples of such torches are for example a juggling torch, a "poi", a "devil stick", a rod or a "swing" torch. Such torches have their own normal pattern throwing motion but can, in general, be thrown, fly in circles, be swung, be circulated etc.

A previously known practical example of such a juggling torch include a juggling club that includes a bar that in a middle area of its length has a heavy body and that has a handle at one of its end and has at its other end a diameter of about 2.5 cm, carry a wick of a fiber material such as Kevlar and/or cotton, wherein the wick has the shape of a band that is wound about the end of the bar along a axial distance of 6–7 cm, wherein the wick has a radial thickness of about 1 cm. The wick is dipped in fuel, such as lamp oil, Kerosene or n-paraffin. The amount of fuel that can be absorbed in such wick has a relatively short burning time. It is in practice difficult to achieve a longer burning time with the help of a bigger wick.

One object of the invention is to design a juggling torch that provides a substantially longer burning time.

The object is achieved with the invention.

The invention is defined in the appended independent claim.

The design variations of the invention are defined in the appended dependent claims.

An important feature of the invention is that the juggling torch includes a container for fuel and that the container is in fuel communication with the wick via one or many channels. Preferably, the container is arranged in the part of the club, one which the wick is arranged, so that a juggling motion of the torch results in that the fuel in the container is conveyed through the channel to and into the wick. The wick permits air therethrough at least when the club is in relative rest so that air may be sucked in through the wick or between the wick and its support and in via the connection to the container, to eliminate the under-pressure that otherwise occurs in the container as a result of the removal of fuel from the container to the wick.

The channel or the channels can have the shape of one or many radial bores at the bottom part of the container so that the channels exit at the lengthwise middle area of the wick.

In one embodiment of the invention the torch can be built from an elongate section of a tube that at its one end has a tight lid for fuel addition purposes. In the other end of the tube, at a distance from its end that corresponds to half of the length of the wick, is a tight bottom that defines a bottom of a container between the bottom and the lid. The channels are formed by the bores through the wall of the tube in the container adjacent of its bottom. The bores that each has a diameter of 1 mm is in practice suitable for a juggling torch that has a wick of 7 cm length and a thickness of 1 cm when the outer diameter of the tube is 22 mm.

A mid-portion of the length of the tube section may be surrounded by a body attached thereto that is rotation symmetrical to the axis of the tube and that suitably has a bore going therethrough that corresponds to the outer diameter of the tube. At the short end, the tube is surrounded by a graspable sleeve.

As a result of the invention the torch can have a burning time that is ten times longer than the burning time of a torch that solely relies on saturating the wick with fuel.

The flow resistance that the channels must provide for the fuel flow to the wick must naturally be adjusted to the characteristics of the wick and the fuel so that the fuel that during the juggling is conveyed from the container through the channels into the wick corresponds to the fuel flow that is burning at the wick.

Based on a conventional wick of Kevlar/cotton yarn, that has an inner diameter of 22 mm, an outer diameter of 42 mm and an axial length of about 65 mm, it has been shown that the juggling torch, that is built from an aluminum tube with a length of 500 mm and a 22 mm diameter satisfy this requirement when two channels extend through the tubing wall (wall thickness 1 mm) and has a diameter of about 1 mm and the fuel has the mentioned characteristics.

The invention is described below with reference to the appended drawings.

BRIEF DESCRIPTION OF THE DRAWINGS

FIG. 1 schematically shows an axial section through the juggling torch

FIG. 2 schematically shows a section along the line II-II in FIG. 1.

DETAILED DESCRIPTION

FIG. 1 shows a juggling torch that is based on a length section of an AL-tube with an outer diameter of 22 mm and a wall thickness of 1 mm. At the one end 11 of the tube 1 a sealing plug 2 is shown that is removable but sealingly inserted into the end of the tube 1. At the other end 12 of the tube 1 there is a circular cylindrical wick applied around the circumference of the tube 1 and that extends to the end of the tube 1. The wick has a length of 6-7 cm and a radial thickness of 1 cm. The wick 3 has a band of Kevlar and/or cotton that is wound about the tube 1 to form the wick 3.

A handle sleeve 4 is mounted on the tube 1 adjacent to the end 11. A club 5, that is rotation symmetrical to the axis of the tube 1, is mounted on the tube 1 and that forms an inert body that defines a suitable position for the center of gravity of the torch along the tube 1. The inner diameter of the club 5 corresponds to the outer diameter of the tube 1.

At the other end 12 of the tube is a bottom wall 14 that shields the inner cross-section of the tube 1. The tube 1 forms, together with the bottom 14 and the plug 2 a container for fuel, such as n-paraffin. In the container, adjacent to the bottom wall 14, are two diametrically opposite bores 15 that have a diameter of 1 mm. The bores 15 form channels, through which fuel from the container can flow to the wick 3. The wick 3 permits air to flow therethrough and can let air in through the bores 15 in the container if an under-pressure is formed in the container relative the surroundings. The torch is usually handled in such a way that its motion brings fuel to move in the direction toward the exit of the container so that fuel is driven out through the channel or channels to the wick. The container is thus arranged so that the fuel is given such a motion or drive towards the channel and the wick during the handling of the juggling torch. Commonly, the juggling torch, in general, is provided a motion during the handling of the torch so that the fuel is given the indicated motion.

During juggling of the torch the fuel can thus be given an inertia force in the direction toward the bottom 14 and strives to be pressed out through the bores 15 to the wick 3. When the wick 3 is moisturized by fuel and is lit, a flame is established that during the juggling act represents fuel consumption. This fuel consumption is to be balanced by a corresponding fuel flow through the bores 15 and the wick 3.

During the sudden interruption of the throwing motion of the torch air can be sucked in through the wick into the container 7 for pressure compensation of the container.

The channels and/or the wick define a flow resistance that at least partially regulates the fuel flow between the container and the burning flame wherein the fuel flow substantially corresponds to the fuel consumption of the flame so that the flame can be maintained without the risk of fuel (burning) leaving the wick during the juggling handling of the torch.

What is claimed is:

1. A juggling torch comprising:

a torch body having a wick, disposed on an outside surface of a sidewall the torch body, for receiving a fuel that is absorbed by the wick, and a fuel container in fuel communication with the wick via one or many channels defined in the sidewall of the torch body.

2. The juggling torch according to claim 1 wherein the channel or channels have a free cross section for the fuel, that during the juggling permits the wick to be provided with a fuel flow that corresponds to the fuel that is burnt on the wick.

3. A juggling torch comprising:

a torch body with a wick for a fuel that is absorbed by the wick, a fuel container that is in a fuel communication with the wick via one or many channels, a free cross sectional area of the channel or channels for receiving the fuel is about 0.3–8 $mm^2$.

4. The juggling torch according to claim 3 wherein a total free cross sectional area for the channel is about 1.5 $mm^2$.

5. The juggling torch according to claim 3 wherein the torch body has a handle at one end and the wick at an other end, the container has a bottom in an area of the wick and the juggling torch has a center of gravity disposed between the wick and the handle.

6. The juggling torch according to claim 3 wherein the torch body has a length section of a tube that at one end has a tight plug for the fuel container and a tight shielding wall at a second end, and the channel or channels are arranged to be adjacent to the wall and exit into the wick.

7. The juggling torch according to claim 6 wherein the wick is arranged to surround the second end portion of the tube section.

* * * * *